US008430710B2

(12) United States Patent
Woessner et al.

(10) Patent No.: US 8,430,710 B2
(45) Date of Patent: Apr. 30, 2013

(54) INTERACTIVE TOY VEHICLE AND METHODS OF USE

(76) Inventors: JoAnn K. Woessner, Paterson, NJ (US); Pamela L. Schwarte, Norwood, NJ (US)

( * ) Notice: Subject to any disclaimer, the term of this patent is extended or adjusted under 35 U.S.C. 154(b) by 528 days.

(21) Appl. No.: 12/217,168

(22) Filed: Jul. 2, 2008

(65) Prior Publication Data

US 2009/0036018 A1 Feb. 5, 2009

Related U.S. Application Data

(60) Provisional application No. 60/962,526, filed on Jul. 30, 2007.

(51) Int. Cl.
*A63H 17/00* (2006.01)

(52) U.S. Cl.
USPC ..... 446/95

(58) Field of Classification Search ..... 446/71, 446/75–78, 93–95, 144, 145, 423, 431, 465, 446/471, 901; 434/219, 373, 374; 273/440, 273/442, 447, 461; 248/176.1, 127, 352
See application file for complete search history.

(56) References Cited

U.S. PATENT DOCUMENTS

| | | | | | |
|---|---|---|---|---|---|
| 1,381,592 | A | * | 6/1921 | Price | 254/89 R |
| 1,538,113 | A | * | 5/1925 | Hernandez | 254/423 |
| 2,040,521 | A | * | 5/1936 | Marx | 446/423 |
| 2,238,573 | A | * | 4/1941 | Steedman | 187/208 |
| 2,587,142 | A | * | 2/1952 | Gray et al. | 446/94 |
| 2,672,709 | A | | 3/1954 | Ernest | |
| 3,811,218 | A | | 5/1974 | Salmon et al. | |
| 3,924,352 | A | * | 12/1975 | Goldfarb et al. | 446/90 |
| 4,120,118 | A | * | 10/1978 | Mathews et al. | 446/144 |
| 4,533,336 | A | * | 8/1985 | Dixon et al. | 446/465 |
| 4,582,500 | A | * | 4/1986 | Hanson et al. | 446/423 |
| 4,767,375 | A | * | 8/1988 | Fassman | 446/423 |
| 4,896,373 | A | * | 1/1990 | Blake | 455/344 |
| 5,203,533 | A | * | 4/1993 | Karen | 248/676 |
| 5,575,660 | A | * | 11/1996 | Hooks | 434/374 |
| 5,997,016 | A | * | 12/1999 | Kaechele | 280/87.021 |
| 6,105,910 | A | * | 8/2000 | Roldan | 248/176.1 |

* cited by examiner

*Primary Examiner* — Gene Kim
*Assistant Examiner* — Alyssa Hylinski
(74) *Attorney, Agent, or Firm* — Dilworth & Barrese

(57) ABSTRACT

A toy vehicle set is provided having a toy automobile including an accessible compartment and defining an underside. A toy automobile component extends from the underside. A lift includes at least one post. The post engages the underside and a ground surface in a configuration to raise the toy automobile a predetermined distance from the ground surface such that the at least one toy automobile component is accessible for interaction during imaginative play.

18 Claims, 6 Drawing Sheets

INTERACTIVE TOY VEHICLE AND METHODS OF USE

CROSS REFERENCE TO RELATED APPLICATION

This patent application claims the benefit of U.S. Provisional Patent Application Ser. No. 60/962,526 filed on Jul. 30, 2007, the contents of which being incorporated herein by reference in its entirety.

TECHNICAL FIELD

This invention generally relates to toy vehicles for educational and dramatic play, and more particularly to an interactive toy vehicle set that provides an occupational experience to aid in development and cognitive learning through imaginative play, such as an automotive mechanic utilizing a vehicle lift configuration.

BACKGROUND OF THE INVENTION

There are many interactive toys, puzzles and games that are commercially available. Although these devices can encourage a child to use their imagination, they may fail to stimulate a desirable level of cognitive learning, or are tedious in nature such that a child loses interest and is not motivated to play with the device.

Many attempts have been made to overcome these drawbacks, including the introduction of imaginative play. Children, whether at home or at school, enjoy imaginative play by engaging in make-believe and imitating those with which they are familiar. However, many parents can be reluctant to introduce a child to real world scenarios for playtime due to potential dangers. Limiting the child's exposure can make it difficult to appreciate the real-world scenario and disadvantageously limits development and cognitive learning.

Toy vehicles are popular with children, as well as adults. There are a number of commercially available toy vehicles in which components are removable. However, these types of toy vehicles may not be realistic in the operations that the playing child is permitted or encouraged to perform, thereby lacking educational value. Such toy vehicles are often constructed with a large number of relatively fragile and delicate parts, which can lead to premature destruction of the toy. Further, the number of parts required in these types of toy vehicles results in high manufacturing costs.

Therefore, it would be desirable to overcome the disadvantages and drawbacks of the prior art with an interactive toy vehicle set and related methods of use that provide an occupational experience to aid in development and cognitive learning through imaginative play. It would be desirable if such a toy vehicle set includes a toy automobile used during imaginative play, such as an automotive mechanic scenario. It would be highly desirable if the toy vehicle set included a mechanic lift configuration and a toy tool set.

SUMMARY OF THE INVENTION

Accordingly, a toy vehicle set and related methods of use are disclosed that provide an occupational experience to aid in development and cognitive learning through imaginative play for overcoming the disadvantages and drawbacks of the prior art. Desirably, the toy vehicle set includes a toy automobile used during imaginative play, such as an automotive mechanic scenario. Most desirably, the toy vehicle set includes a mechanic lift configuration and a toy tool set.

For example, the toy vehicle set including a toy automobile and related methods of use provide a child with a fun toy structure that enables a child to engage in imaginative play as in an automotive mechanic scenario. The toy vehicle set enhances dramatic play and strengthens the imagination of the child. The toy vehicle set and related methods of use provide a child with the ability to develop fine motor skills and perfect identification of colors and shapes. The toy vehicle set can be used at home or in a classroom.

In one particular embodiment, in accordance with the principles of the present disclosure, the toy vehicle set may include a toy tool set. The toy automobile can have an engine compartment for disposal of toy automobile components and tires removable from a chassis of the toy automobile. The tires are mounted with the chassis via a removable axle portion, which attaches the tire to the chassis. The axle portion is configured for manipulation by a toy tire iron for removing and mounting the tires to the chassis. The underside surface of the toy automobile includes several threaded bolts with rotatable nuts attached thereto. The bolts can be permanently attached to the toy automobile and the nuts can be manipulated by a toy tool. The toy tool set may include a wrench provided with a socket for engaging the bolt heads to tighten or loosen the bolts for replacing or removing the various toy automobile components with respect to the chassis of the vehicle. The bolts, nuts and/or the toy tool set can be color coded, as well as alternately shaped and dimensioned. These components are sufficiently large relative to the size of the toy automobile so that a child playing with the toy vehicle set may readily engage and remove or replace the components to aid in development and cognitive learning.

In another embodiment, the toy vehicle set includes a structure made in the shape of a car, designed to allow a child to pretend to be an automotive mechanic. The car is fabricated from brightly colored, plastic material created for children aged 4-7. The car is positioned atop four permanent posts that lift the vehicle, allowing the child to work beneath the car. Permanently secured to the bottom of the vehicle are a predetermined number of bolts, each with a nut that can be turned to move up and down along the bolt but cannot be removed completely from the bolt. There are several snap-in and out pieces located beneath the hood. These pieces are made to represent parts, such as a battery, oil filter, air filter, and plugs. The pieces fit onto shape specific nodules, making replacement simple. A toy wrench and screwdriver are used to manipulate the nuts and bolts under the hood and underneath the car. Each tire and its accompanying bolt can be removed and replaced using a toy tire iron tool. The head of each bolt features a different shape, which will match one of the four sides of the tire iron tool. The child can enjoy working on his car using color-coded toy tools. The trunk and the hood open and close, allowing the child to inspect these areas of the vehicle, as desired. A license plate can also be mounted with the toy vehicle set. In this embodiment, the car measures approximately 40" high, 40" long and 23" wide. Various sizes are envisioned depending on storage and assembly considerations.

In another embodiment, a toy vehicle set is provided, which includes a toy automobile having at least one accessible compartment and defining an underside. At least one toy automobile component extends from the underside. A lift includes at least one post. The post engages the underside and a ground surface in a configuration to raise the toy automobile a predetermined distance from the ground surface such that the at least one toy automobile component is accessible for interaction during imaginative play.

The at least one accessible compartment can include a cavity defined adjacent a front end of the toy automobile and a hood, movable relative to the toy automobile, configured to enclose the cavity. The cavity may be configured for disposal of at least one toy automobile component. The at least one accessible compartment may include a cavity defined adjacent a rear end of the toy automobile, and a trunk movable relative to the toy automobile and configured to enclose the cavity. The at least one toy automobile component may include at least one threaded bolt and a rotatable nut connected therewith. The at least one toy automobile component may be permanently secured to the underside. The at least one toy automobile component may be snap-fit with the at least one accessible compartment.

The toy automobile can include at least one removable tire attachable to the toy automobile via a removable axle portion. It is envisioned that the predetermined distance is sufficiently dimensioned to allow for disposal of a child between the underside and the ground surface. The at least one post can include a plurality of posts. The underside can have a substantially rectangular configuration and defines front and rear corners of the toy automobile. The at least one post includes a pair of posts disposed adjacent the front corners and a pair of posts disposed adjacent the rear corners.

The at least one toy automobile component includes a plurality of threaded bolts and rotatable nuts connected therewith, each bolt having an alternately configured head. The toy vehicle set may include at least one toy tool configured to manipulate the at least one toy automobile component for interaction during imaginative play. The at least one toy tool can include a toy tire iron having a plurality of color coded arms configured for engagement with a plurality of corresponding color coded toy automobile components.

In an alternate embodiment, a method of teaching through imaginative play is provided. The method includes the steps of providing a toy automobile, similar to that described herein; providing a lift including at least one post; the post engaging the underside of the toy automobile and a ground surface in a configuration to raise the toy automobile a predetermined distance from the ground surface such that the at least one toy automobile component is accessible for interaction during imaginative play; employing the lift such that the predetermined distance is sufficiently dimensioned to allow for disposal of an individual between the underside and the ground surface; providing the individual with a toy tool configured for manipulation of the at least one toy automobile component; and directing the individual to engage in imaginative play with the toy automobile and the toy tool to facilitate development and cognitive learning of the individual.

The method can include the step of directing, which includes imaginative play as an automotive mechanic.

The imaginative play may include the individual accessing the at least one accessible compartment and interacting with at least one toy automobile component disposed in the at least one accessible compartment. The at least one toy automobile component can include at least one threaded bolt and a rotatable nut connected therewith, and the imaginative play includes the individual employing the toy tool to interact with the bolt and the nut. The toy automobile includes at least one removable tire attachable to the toy automobile via a removable axle portion, and the imaginative play includes the individual employing the toy tool to interact with the tire and the axle portion.

In another alternate embodiment, a toy vehicle set configured for imaginative play to facilitate a child's development and cognitive learning is provided. The toy vehicle set includes a toy automobile defining a front end, a rear end, and an underside. An accessible compartment is disposed adjacent the front end and defines a cavity. The accessible compartment includes a hood being relatively movable to the toy automobile and configured to enclose the cavity. The cavity is configured for disposal of toy engine parts. A pair of removable front tires are disposed adjacent the front end and a pair of removable rear tires are disposed adjacent the rear end. The tires are attachable with the toy automobile via removable axle portions engageable with the toy automobile. The underside has a substantially rectangular configuration and includes a plurality of threaded bolts extending therefrom. The bolts are permanently secured to the underside and includes nuts being rotatable thereon. A lift includes a pair of posts disposed adjacent the front end and a pair of posts disposed adjacent the rear end. The posts are configured to support the toy automobile and engage the underside and a ground surface in configuration to raise the toy automobile a predetermined distance from the ground surface such that the threaded bolts are accessible during imaginative play. A toy tool set includes a tire iron configured to engage the removable axle portions.

DETAILED DESCRIPTION OF THE INVENTION

Figure 1:
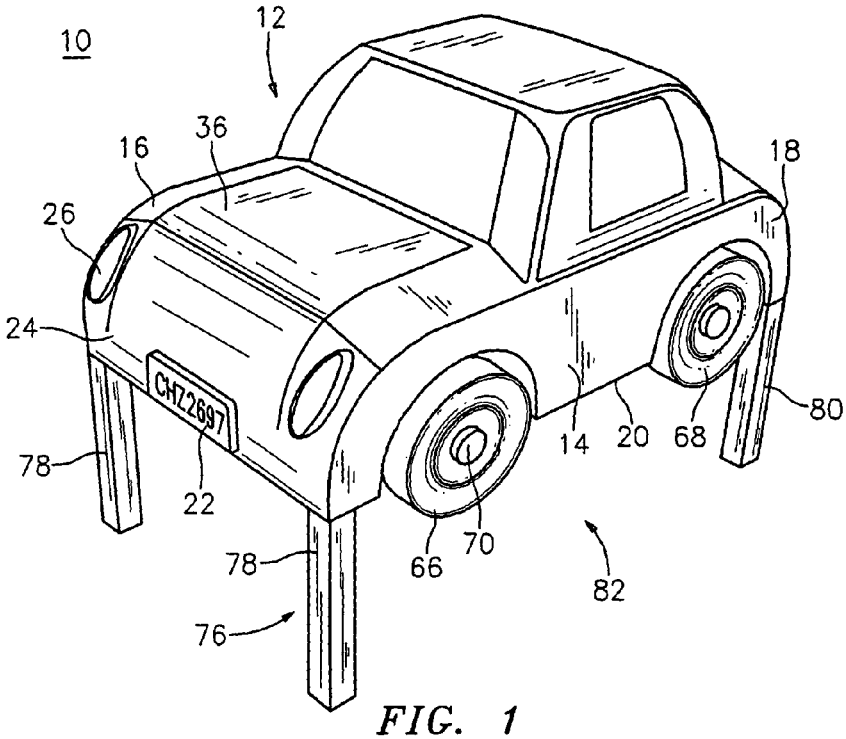
FIG. 1 is a perspective view of one particular embodiment of a toy vehicle set in accordance with the principles of the present disclosure.

The exemplary embodiments of the interactive toy vehicle set including a toy automobile and methods of use disclosed are discussed in terms of toy vehicles for educational and dramatic play and more particularly, in terms of an interactive toy automobile that provides an occupational experience to aid in development and cognitive learning through imaginative play. It is contemplated that the imaginative play scenario is an individual working with an automobile, such as an automotive mechanic. It is further contemplated that such imaginative play includes an automotive mechanic utilizing a vehicle lift configuration. It is envisioned that the present disclosure may be employed for various applications of imaginative play such as, for example, policeman, fireman, construction worker, etc. The present disclosure may be employed with a variety of learning and education applications including those suited for children, learning disabled, adult, etc. It is contemplated that the toy automobile may be employed for general play applications.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

The following discussion includes a description of a toy vehicle set, related components and exemplary methods of employing the toy vehicle set in accordance with the principles of the present disclosure. Alternate embodiments are also disclosed. Reference will now be made in detail to the exemplary embodiments of the present disclosure, which are illustrated in the accompanying figures. Turning now to FIGS. 1-6, there is illustrated a toy vehicle set 10 in accordance with the principles of the present disclosure.

The components of toy vehicle set 10 are fabricated from materials suitable for general play and education applications, depending on the particular preference. One skilled in the art, however, will realize that such materials and fabrication methods suitable for assembly and manufacture, in accordance with the present disclosure, would be appropriate. The various components that are used in the manufacture of the toy vehicle set may be formed of various conventional plastic materials including polyethylene, polystyrene, polybutadiene and any of a number of vinyladiene copolymers, etc. These components may be made from various plastic forming operations, including injection molding, thermo-forming, or the like. Alternatively, these components can be made from other materials including lightweight metals, fiber reinforced plastics, etc.

Figure 2:
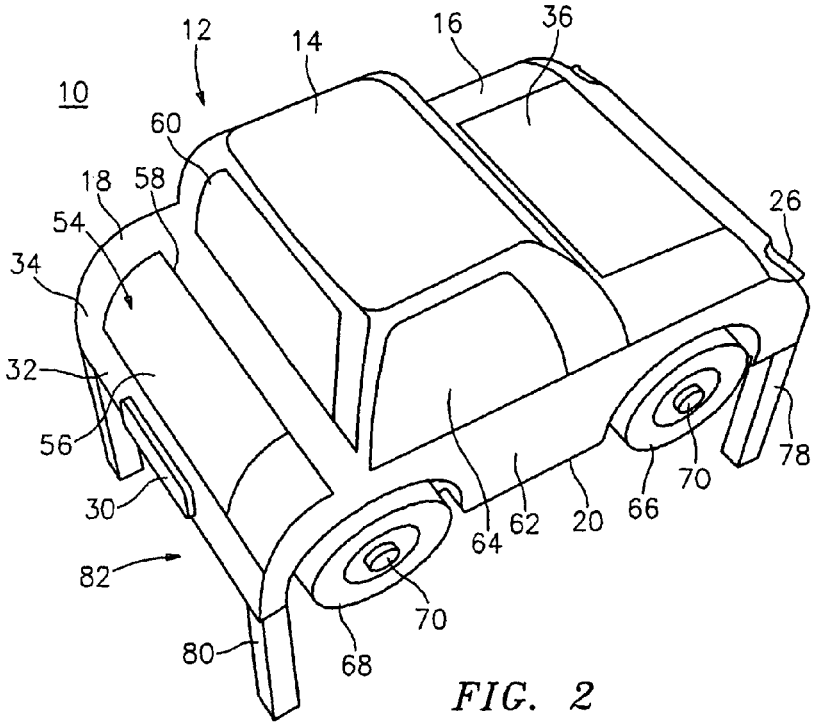
FIG. 2 is a perspective view of the toy vehicle set shown in FIG. 1.

Toy vehicle set 10 is configured for imaginative play to facilitate a child's development and cognitive learning. Toy vehicle set 10 includes a toy automobile 12 having a body 14, as shown in FIGS. 1 and 2. Body 14 has a substantially rectangular configuration and is in the shape of a sedan automobile. It is envisioned that body 14 may be configured as a truck, convertible, etc. It is further envisioned that body 14 may be specifically styled as a police vehicle, fire/rescue vehicle, dump truck, etc.

Body 14 defines a front end 16, a rear end 18 and an underside 20. Front end 16 includes a license plate 22 mounted to a front face 24 of body 14. License plate 22 may be attached and removed with a toy tool, discussed below. Headlights 26 are mounted with openings 28 (FIG. 4) of front end 16. Headlights 26 may be attached and removed with a toy tool or manually manipulated, depending on the particular teaching application. It is envisioned that license plate 22 and headlights 26 may be configured as ornamentation for body 14, and fixedly mounted thereto and not designed for removal during play.

Rear end 18 includes a license plate 30 mounted to a rear face 32. License plate 30 may be attached and removed with a toy tool. Taillights 34 are mounted with openings (not shown) of rear end 18. Taillights 34 may be attached or removed with a toy tool, or manually manipulated. It is contemplated that license plate 30 and taillights 34 may be configured as ornamentation for body 14, and fixedly mounted thereto and not designed for removal during play. It is further contemplated that body 14 may include other attachable/removable structure or ornamentation, such as mirrors, lights, etc.

Toy automobile 12 includes an accessible-compartment such as, for example, engine compartment 36. Engine compartment 36 is disposed adjacent front end 16 and defines a cavity 38. Engine compartment 36 includes a hood 40, which is movable relative to toy automobile 12 and configured to enclose cavity 38.

Hood 40 conforms to the shape of body 14 and pivots about a connection 42 with body 14. Hood 14 freely rotates about connection 42 and rests on a windshield 44 in an open position. Hood 14 rests in flush alignment with body 14 in the closed position. It is envisioned that hood 40 may be resiliently biased to the open and closed positions via a spring or the like. It is further envisioned that hood 40 may pivot about a connection with body 14 adjacent front face 24. Hood 14 may include handles for manipulation thereof between the open and closed positions.

Figure 4:
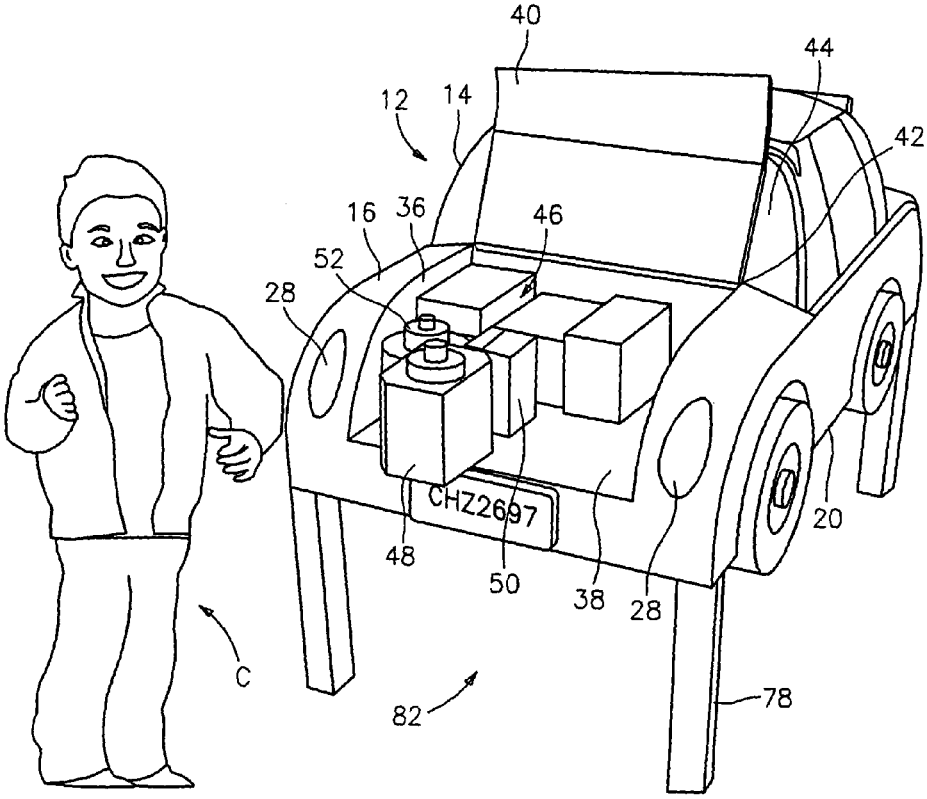
FIG. 4 is a cutaway perspective view of the toy vehicle set shown in FIG. 1 and a child, illustrating activity during play.

Cavity 38 is configured for disposal of toy automobile components, as shown in FIG. 4. It is contemplated that cavity 38 may be variously configured and dimensioned according to the design of body 14. It is further contemplated that engine compartment 36 may be divided into sections, including hood 40, or that toy automobile 12 does not include an engine compartment 36. The toy automobile components include, for example, engine parts 46 including an oil receptacle 48, battery 50, engine coolant receptacle 52, etc. Engine compartment 36 may include one or a plurality of engine parts 46.

Engine parts 46 may be engaged with a toy tool or manually engaged during play. It is contemplated that engine parts 46 may be removed from engine compartment 36 or have a portion thereof opened for access to interior holding portions. Engine parts 46 may be snap fit with engine compartment 36.

Toy automobile 12 includes an accessible compartment, such as, for example, trunk 54, as shown in FIG. 2. Trunk 54 is disposed adjacent rear end 18 and defines a cavity (not shown). Trunk 54 includes a panel 56, which is movable relative to toy automobile 12 and configured to enclose the cavity of trunk 54. Trunk 54 is configured for disposal of toy automobile components, tires, etc. Panel 56 conforms to the shape of body 14 and pivots about a connection 58 with body 14. Panel 56 freely rotates about connection 58 and rests on a rear window 60 in an open position. Panel 56 rests in flush alignment with body 14 in a closed position. It is contemplated that panel 56 may be resiliently biased to the open and closed positions via a spring or the like. Trunk 54 may be divided into sections, including panel 56. It is envisioned that body 14 may not include the cavity of trunk 54.

Toy automobile 12 includes side doors 62 monolithically formed with body 14, and having side windows 64. It is envisioned that side doors 62 can be separately formed and mounted to body 14 so as to pivot thereabout between open and closed positions. Windows 44, 60 and 64 are opaque. It is contemplated that windows 44, 60 and 64 may be transparent, or have various degrees of transparency. Windows 44, 60 and 64 may also be configured for attachment and/or removal during play with a toy tool or via manual manipulation.

Figure 3:
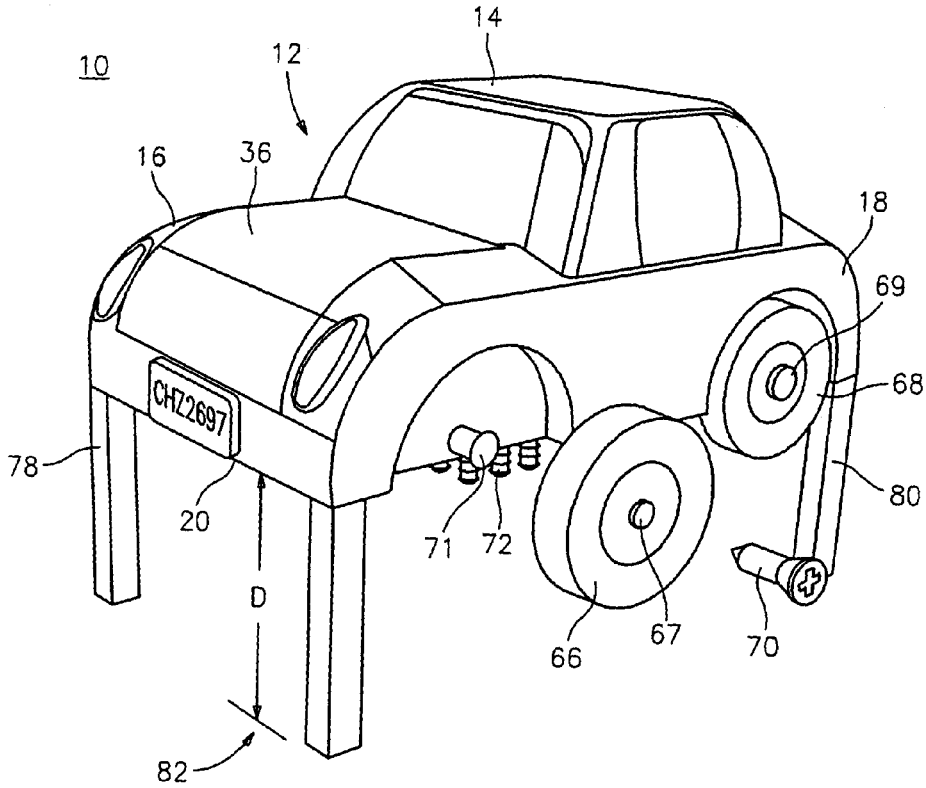
FIG. 3 is a perspective view of the toy vehicle set shown in FIG. 1 illustrating activity during play.

Toy automobile 12 includes a pair of removable front tires 66 disposed adjacent front end 16 and a pair of removable rear tires 68 disposed adjacent rear end 18, as shown in FIG. 3. Tires 66, 68 are attachable with body 14 via removable axle portions 70 engageable with body 14. Axle portion 70 is inserted with a centrally disposed opening 67 of tire 66 for reception with a cavity 71 of body 14 for mounting tire 66 to body 14. Similarly, axle portion 70 is inserted with a centrally disposed opening 69 for mounting tire 68 to body 14. Tires 66, 68 may also include radially spaced lug nuts for mounting. Tires 66, 68 may be attached or removed with a toy tool, such as a toy tire iron, or manually manipulated, or alternatively, fixedly mounted to body 14.

Figure 5:
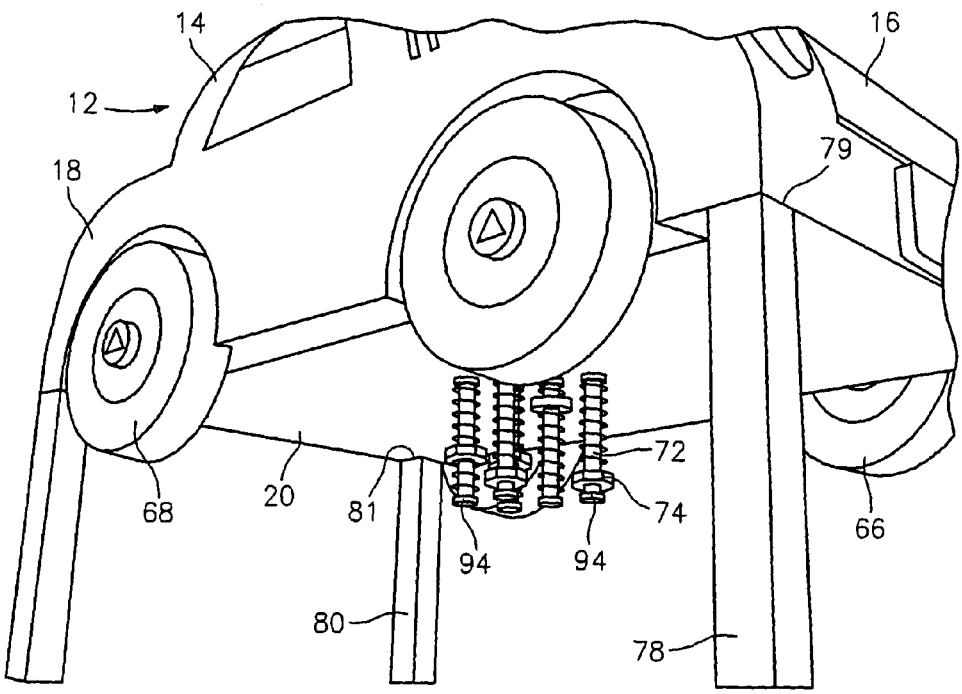
FIG. 5 is a cutaway perspective view of the toy vehicle set shown in FIG. 1 illustrating underside components.

Underside 20 has a substantially rectangular configuration and includes a plurality of threaded bolts 72 extending therefrom. Bolts 72 are permanently secured to underside 20 and include nuts 74 being rotatable thereon, as shown in FIG. 5. Nuts 74 may be engaged with a tool toy, such as a wrench 88 (FIG. 6), for rotation thereof during play. Bolts 72 and 74 may be color coded with variously sized and/or dimensioned tools of a toy tool set or dimensionally coded in a similar manner. It is envisioned that bolts 72 can be removable from body 14.

A lift 76 includes a pair of posts 78 disposed adjacent front end 16 and a pair of posts 80 disposed adjacent rear end 18. Posts 78, 80 are configured to support toy automobile 12 and engage underside 20, and a ground surface 82, in configuration to raise toy automobile 12 a predetermined distance D from ground surface 82 such that threaded bolts 72 are accessible during imaginative play. The length of distance D corresponds to the length of posts 78, 80, which is of sufficient dimension to facilitate access by an individual, desirably a child, to underside 20. Preferably, the child is disposed underneath body 14, either standing or supine. Posts 78 are mounted with a recessed cavity 79 for assembling posts 78 with body 14, as shown in FIG. 5. Posts 80 are mounted with a recessed cavity 81 for assembling posts 80 with body 14. It is envisioned that posts 78, 80 may be threaded, snap-fit, etc. for removable manipulation. It is further envisioned that toy vehicle set 10 may include a plurality of variable sized posts 78, 80. It is contemplated that posts 78, 80 may be adjustable in length, via, for example, telescoping.

Figure 6:
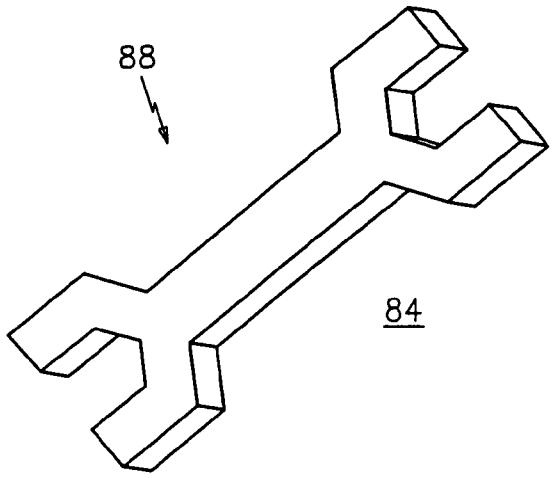
FIG. 6 is a perspective view of a toy tool set of the present disclosure.
Figure 7:
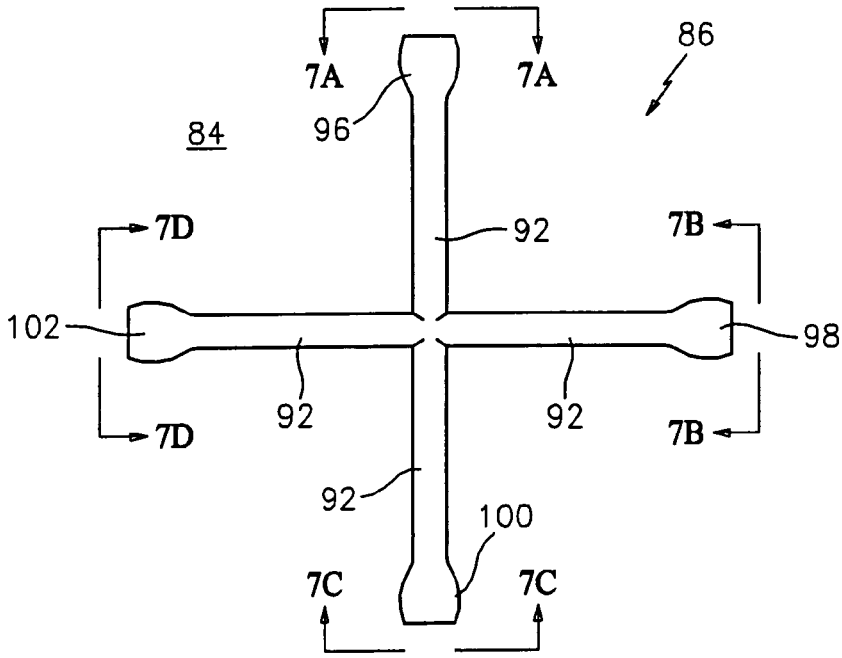
FIG. 7 is a view of a tool of the present disclosure.
Figure 7A:
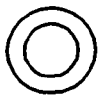
FIG. 7A-7D are views of various heads of the present disclosure.
Figure 7B:
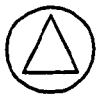
Figure 7C:
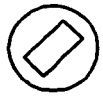
Figure 7D:
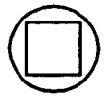

Toy vehicle set 10 includes a toy tool set 84, as shown in FIGS. 6 and 7, for engaging the components of toy automobile 12, as described. Toy tool set 84 includes a tire iron 86 configured to engage removable axle portion 70. Toy tool set 84 also includes a wrench 88 and a screwdriver (not shown) configured to engage engine parts 46. Tire iron 86 has a plurality of color coded arms 92 configured for engagement with a plurality of color coded bolts 72 and nuts 74. Bolts 72 have alternately configured heads 94 (see FIGS. 7A-7D). Heads 94 may be geometrically configured as square, circular, polygonal, etc., correspondingly mate with an engagement portion of arms 92 of tire iron 86. For example, the engagement portions include circular shaped socket 96, triangle shaped socket 98, rectangular shaped socket 100 and square shaped socket 102. Other geometric shapes are contemplated. Each socket may be alternatively colored (red, blue, yellow, green, etc.) to correspondingly mate with a similarly colored head 94. Wrench 88 and the screwdriver may be similarly designed with color coding and geometric shapes. It is envisioned that the color-coding and geometric features of the present disclosure may be included with only one or a plurality of the components of toy vehicle set 10. Alternatively, toy vehicle set 10 may not include the above-mentioned color-coding and geometric features.

In one embodiment, in accordance with the principles of the present disclosure, in a method of teaching through imaginative play, toy automobile 12, similar to that described above, is provided to facilitate development and cognitive learning of a child C (FIG. 4). Lift 76 is provided and assembled with toy automobile 12. Posts 78 are assembled with recessed cavities 79, and posts 80 are assembled with recessed cavities 81, to mount lift 76 with toy automobile 12. Upon mounting posts 78, 80 with the body 14, posts 78, 80 are disposed with body 14 in an upright orientation such that posts 78, 80 engage ground surface 82 in a configuration to raise toy automobile 12 predetermined distance D from ground surface 82. In this orientation, child C may be orientated between underside 20 and ground surface 82, under body 14, similar to the position an automotive mechanic would be disposed while working on an automobile. It is contemplated that child C may be standing or supine between underside 20 and ground surface 82.

With body 14 suspended by lift 76 a sufficient distance to allow for disposal of child C, child C is provided with a toy tool of toy tool set 84 for manipulation of a toy automobile component or tires 66, 68. Child C is directed to engage in imaginative play with toy automobile 12 and toy tool set 84 to facilitate development and cognitive learning for child C. For example, child C can grasp tire iron 86 to change a tire 66, 68. With tire 66 mounted to body 14, tire iron 86 is manipulated to engage axle portion 70 to release it from supporting cavity 71 of body 14. The particular matching socket of arm 92 of tire iron 86 correspondingly engages axle portion 70. In this example, a protruding cross configuration of arm 92 engages and mates with a female cross configuration of axle portion 70. Child C can loosen or tighten axle portion 70 with tire iron 86, via threaded engagement or the like, to remove tire 66. This improves dexterity of the Child C, as well as aiding in development and learning. Axle portion 70 is removed by child C and tire 66 removed from body 14. Tire 66 can be attached by placing tire 66 on the receptacle with cavity 71 and manipulating axle portion 70 with tire iron 86, as described, for insertion within cavity 71. Tire 68 can be similarly removed and replaced.

In another example, child C can manipulate tire iron 86, wrench 88 and/or the screwdriver to work with engine parts 46 disposed in engine compartment 36. Child C can change the oil and filter, check the battery, etc. The geometric configurations and/or color added scheme of the toy tools are correspondingly configured or color coded with the particular engine part 46 for repair, removal, maintenance, etc. This aids the child's development through identification and matching exercises relating to color and shape to facilitate learning.

In yet another example, child C can manipulate tire iron 86, wrench 88 and/or the screwdriver to work with bolts 72 and nuts 74 disposed with underside 20. Arms 92 of tire iron 86 can be color coded for corresponding engagement with color coded heads 94 of bolts 72 and/or nuts 74. Arms 92 can also be geometrically configured corresponding to the configuration of heads 94 and nuts 74. Wrench 88 and the screwdriver can be similarly configured.

Toy vehicle set 10 is a fun toy and instructional device, designed to allow a child to pretend to be an automotive mechanic. In an alternate embodiment, the components of toy vehicle set 10 can be fabricated from brightly colored plastic suited for children aged 4-7. In another alternate embodiment, the assembled toy vehicle set 10 occupies a space that measures approximately 40" high, 40" long and 23" wide, however other sizes are contemplated for storage and assembly considerations.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. An educational toy vehicle set comprising:

a toy automobile including at least one accessible compartment, the toy automobile defining a front, a rear, sides and an underside surface oriented to face a ground surface and having tires positioned thereon, the underside surface being a lower most portion of the toy automobile;

at least one toy automobile component extending from a portion of the underside surface configured for interaction during imaginative play; and a lift including a pair of posts disposed adjacent to the front and sides and a pair of posts disposed adjacent to the rear and sides, the posts being configured for assembly with the underside surface in a mounted configuration, the underside surface defining a recessed cavity for each post and each post attaching to the toy vehicle when the post is engaged within a respective recessed cavity, and engaging the underside surface and the ground surface in a configuration to raise the toy automobile a predetermined distance from the ground surface such that the at least one toy automobile component extending from a portion of the underside surface is accessible for realistic interaction during imaginative play.

2. A toy vehicle set according to claim 1, wherein the at least one accessible compartment includes a cavity defined adjacent a front end of the toy automobile and a hood, movable relative to the toy automobile, configured to enclose the cavity.

3. A toy vehicle set according to claim 1, wherein the at least one accessible compartment includes a cavity defined adjacent a rear end of the toy automobile and, a trunk movable relative to the toy automobile and configured to enclose the cavity.

4. A toy vehicle set according to claim 1, wherein the at least one toy automobile component includes at least one threaded bolt and a rotatable nut connected therewith.

5. A toy vehicle set according to claim 1, wherein the toy automobile includes at least one removable tire attachable to the toy automobile via a removable axle portion.

6. A toy vehicle set according to claim 1, wherein the predetermined distance is sufficiently dimensioned to allow for disposal of a child between the underside and the ground surface.

7. A toy vehicle set according to claim 1, wherein the at least one toy automobile component is permanently secured to the underside.

8. A toy vehicle set according to claim 1, wherein the at least one toy automobile component is in snap-fit engagement with the at least one accessible compartment.

9. A toy vehicle set according to claim 1, wherein the at least one toy automobile component includes a plurality of threaded bolts and rotatable nuts connected therewith, each bolt having an alternately configured head.

10. A toy vehicle set according to claim 1, further comprising at least one toy tool configured to manipulate the at least one toy automobile component for interaction during imaginative play.

11. A toy vehicle set according to claim 10, wherein the at least one toy tool includes a toy tire iron having a plurality of color coded arms configured for engagement with a plurality of corresponding color coded toy automobile components.

12. A method of teaching through imaginative play, the method comprising the steps of:

providing a toy automobile, the toy automobile including at least one accessible compartment, the toy automobile defining a front, a rear, sides and an underside surface oriented to face a ground surface and having tires positioned thereon, the underside surface being a lower most portion of the toy automobile, and at least one toy automobile component extending from a portion of the underside surface configured for interaction during imaginative play;

providing a lift including a pair of posts disposed adjacent to the front and sides and a pair of posts disposed adjacent to the rear and sides, the posts being configured for assembly with the underside surface in a mounted configuration, the underside surface defining a recessed cavity for each post and each post attaching to the toy vehicle when the post is engaged within a respective recessed cavity, and engaging the underside surface and the ground surface in a configuration to raise the toy automobile a predetermined distance from the ground surface such that the at least one toy automobile component extending from a portion of the underside surface is accessible for realistic interaction during imaginative play;

employing the lift such that the predetermined distance is sufficiently dimensioned to allow for disposal of an individual between the underside surface and the ground surface;

providing the individual with a toy tool configured for manipulation of the at least one toy automobile component; and directing the individual to engage in imaginative play with the toy automobile and the toy tool to facilitate development and cognitive learning of the individual.

13. A method of teaching according to claim 12, wherein the step of directing includes imaginative play as an automotive mechanic.

14. A method of teaching according to claim 12, wherein the imaginative play includes the individual accessing the at least one accessible compartment and interacting with at least one toy automobile component disposed in the at least one accessible compartment.

15. A method of teaching according to claim 12, wherein the at least one toy automobile component includes at least one threaded bolt and a rotatable nut connected therewith, and the imaginative play includes the individual employing the toy tool to interact with the bolt and the nut.

16. A method of teaching according to claim 12, wherein the toy automobile includes at least one removable tire attachable to the toy automobile via a removable axle portion, and the imaginative play includes the individual employing the toy tool to interact with the tire and the axle portion.

17. A toy vehicle set configured for imaginative play to facilitate a child's development and cognitive learning, the toy vehicle set comprising:

a toy automobile defining a front end, a rear end, sides and an underside surface oriented to face a ground surface and having tires positioned thereon, the underside surface being the lower most portion of the toy automobile, the toy automobile including an accessible compartment disposed adjacent the front end and defining a cavity, the accessible compartment including a hood being relatively movable to the toy automobile and configured to enclose the cavity, the cavity being configured for disposal of toy engine parts;

the toy automobile further including a pair of removable front tires disposed adjacent the front end and a pair of removable rear tires disposed adjacent the rear end, the tires being attachable with the toy automobile via removable axle portions engageable with the toy automobile;

the underside surface having a substantially rectangular configuration and including a central region configured for interaction during imaginative play, the central region including a plurality of threaded bolts extending therefrom, the bolts being permanently secured to the underside surface and including nuts being rotatable thereon;

a lift including a pair of posts disposed adjacent the front end and sides and a pair of posts disposed adjacent the rear end and sides, the posts being configured for assembly with the underside surface in a mounted configuration, the underside surface defining a recessed cavity for each post and each post attaching to the toy vehicle when the post is engaged within a respective recessed cavity, and configured to support the toy automobile and engage the underside surface and the ground surface in a configuration to raise the toy automobile a predetermined distance from the ground surface such that the threaded bolts are accessible for realistic interaction during imaginative play; and a toy tool set including a tire iron configured to engage the removable axle portions.

18. A toy vehicle set according to claim 1, wherein the at least one toy automobile component extends from a central region of the portion of the underside surface configured for interaction during imaginative play.

* * * * *